United States Patent [19]

Kingston

[11] Patent Number: 4,860,487

[45] Date of Patent: Aug. 29, 1989

[54] MULTI-CYCLE SEA BED TRAVERSING SYSTEM

[76] Inventor: William Kingston, 49 Sandymount Avenue, Dublin 4, Ireland

[21] Appl. No.: 509,016

[22] Filed: Jun. 29, 1983

Related U.S. Application Data

[63] Continuation-in-part of Ser. No. 274,519, Jun. 17, 1981, abandoned.

[51] Int. Cl.[4] ..... A01K 69/08

[52] U.S. Cl. ..... 43/102; 43/43.13; 114/331; 441/29

[58] Field of Search ..... 43/100, 102, 103, 104, 43/106, 43.13, 43.14; 114/330, 331, 333; 441/2, 21, 25, 29

[56] References Cited

U.S. PATENT DOCUMENTS

| | | | |
|---|---|---|---|
| 1,177,157 | 3/1916 | Walker . | |
| 2,520,562 | 8/1950 | Peeler | 43/43.13 |
| 3,436,776 | 4/1969 | Davis | 9/8 |
| 3,570,437 | 3/1971 | Davis | 114/16 E |
| 3,724,120 | 4/1973 | Richard | 43/100 |
| 3,738,046 | 6/1973 | Johnson | 43/43.13 |
| 3,852,908 | 12/1974 | Christopher | 43/102 |
| 3,864,772 | 2/1975 | Gogolick | 114/16 E |
| 3,952,349 | 4/1976 | Erath . | |
| 4,034,693 | 7/1977 | Challenger | 43/100 |
| 4,092,797 | 6/1978 | Azurin | 43/102 |

FOREIGN PATENT DOCUMENTS

| | | | |
|---|---|---|---|
| 2324709 | 11/1974 | Fed. Rep. of Germany . | |
| 1407979 | 10/1975 | United Kingdom . | |
| 1424527 | 2/1976 | United Kingdom | 114/16 E |

*Primary Examiner*—Nicholas P. Godici

[57] ABSTRACT

An inflatable float with timer and pressure controls to enable underwater gear to be automatically lifted off the sea bed at intervals and moved to a new location. The gas for inflating the float may be generated by chemical means or galvanic action.

3 Claims, 3 Drawing Sheets

MULTI-CYCLE SEA BED TRAVERSING SYSTEM

This is a continuation-in-part of application Ser. No. 06/274,519, filed June 17, 1981 now abandoned.

BACKGROUND OF THE INVENTION

Underwater gear, such as instruments, bottom sampling equipment or fish traps, has to be moved frequently over the sea bed, and this invention provides a means of doing this without having to use a boat.

SUMMARY OF THE INVENTION

The invention consists of an inflatable float, with timer means of controlling its inflation and deflation. A hydrofoil moves the gear laterally in the course of its vertical movements, one method of timing control uses tidal movements, and there may be a chemical source of gas for inflation.

BRIEF DESCRIPTION OF THE DRAWINGS

In the accompanying drawings of the preferred embodiment.

DESCRIPTION OF THE PREFERRED EMBODIMENT

Figure 1:
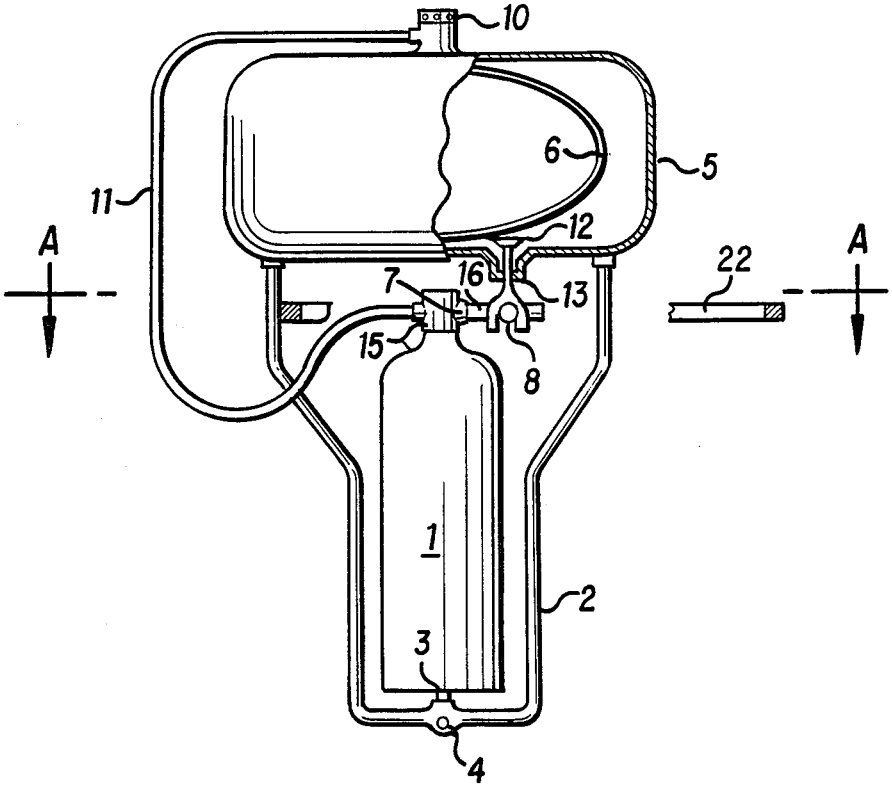
FIG. 1 is an elevation view of the float system with a section of the float chamber.

In FIG. 1, 1 is a cylinder containing air under pressure, held in a frame 2 by retaining pin 3. A string of fish traps, for example, can be attached to frame 3 at lug 4.

The upper end of frame 2 is attached to pressure-resistant float chamber 5, which contains an inflatable bladder 6. Valve 7 controls the release of air from cylinder 1, and is actuated by arcuate movement of arm 8. Valve 10 is a standard item, actuated by ambient water pressure so as to control the deflation of bladder 6. Normally, valve 10 will open when ambient water pressure equals atmospheric pressure, that is, when the system reaches the surface. However, it can be set to operate at any desired ambient water pressure, that is, when the system has risen to any desired depth. Air passes from cylinder 1 to bladder 6 through tube 11.

Water can enter and leave chamber 5 through flooding valve 12, to the underside of which is fixed fork 13 which straddles arm 8.

Figure 4:
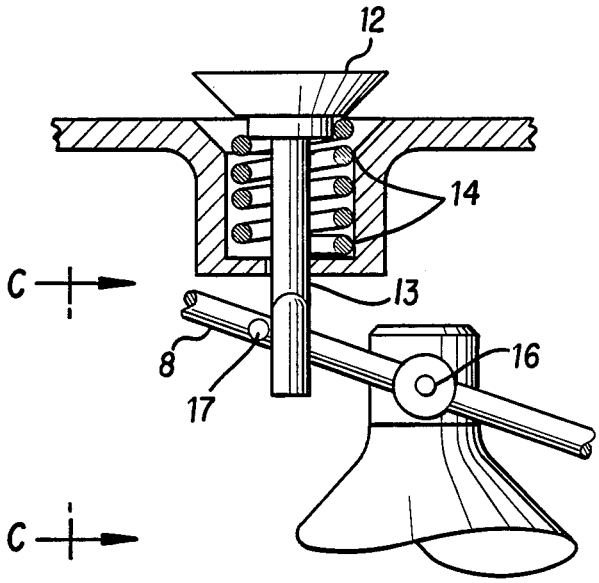
FIG. 4 is an elevational view of part of the valve control mechanism of the gas source, with the flooding valve of the float chamber shown in section.
Figure 5:
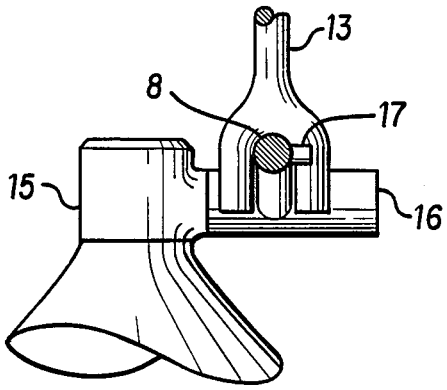
FIG. 5 is an elevational view of the same valve mechanism in the direction C—C.

As shown in FIG. 4, compression spring 14 normally keeps valve 12 in the open position. The relationship between fork 13 and arm 8 is shown in detail in FIG. 5. Rotatable stem 16 of valve 7 in housing 15, is fixed at right angles into arm 8 at its mid-point. Pin 17 in arm 8 helps to keep arm 8 and fork 13 in their correct relative positions.

Figure 2:
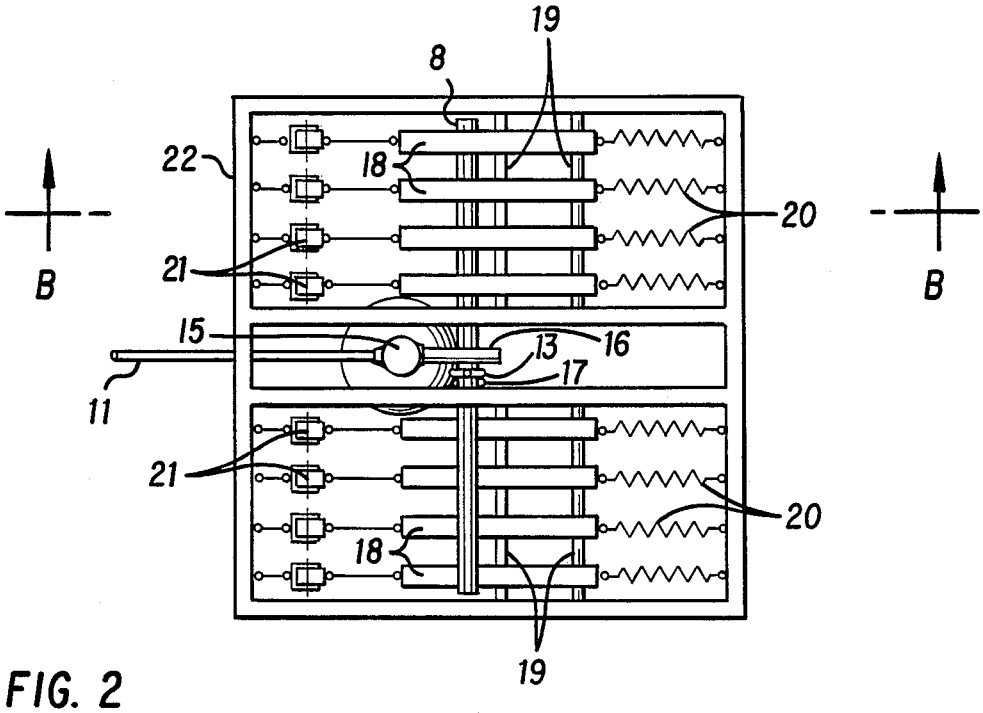
FIG. 2 is a plan view on the section line A—A, illustrating one system of controlling inflation of the float.
Figure 3:
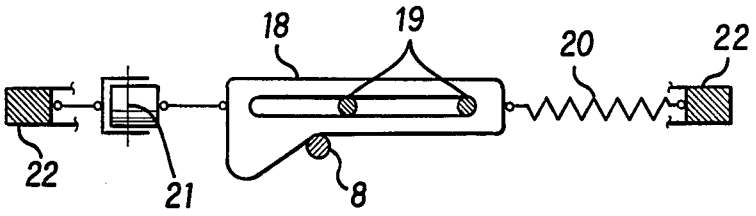
FIG. 3 is a sectional elevational view, taken on the line B—B, showing a typical corrodable link and cam of the control system of FIG. 2.

In FIG. 3, cam 18 can move along guide rods 19,19 under the influence of tension spring 20, unless restrained by corrodable link assembly 21. The movement of cam 18 is such that it displaces arm 8 in passing it, but at the end of its travel is completely clear of arm 8. An array of such cams, springs and links is mounted in frame 22, which in turn is mounted on frame 2. Cams on opposite sides of valve stem 16 also act on opposite surfaces of arm 8, as shown in FIG. 2, so that the force of every cam, irrespective of its position in the array, always acts so as to turn arm 8 arcuately in the same direction, which rotates valve stem 16 to open valve 7.

Figure 6:
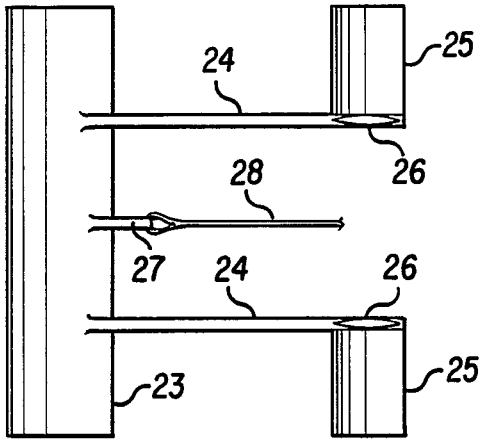
FIG. 6 is a plan view of a hydrofoil sinker.
Figure 7:
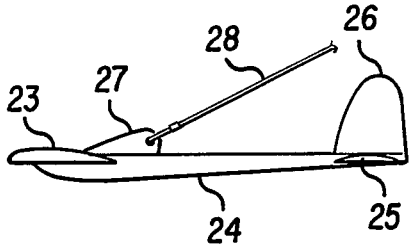
FIG. 7 is an elevational view of the same.

In FIGS. 6 and 7, hydrofoil section 23 has attached to it booms 24, 24, carrying tailplane 25, 25 and vertical fins 26, 26. Mounting bracket 27 attaches rope 28 to section 23.

In operation, a string of items of gear such as fish traps on line 28, attached at one end to the float at lug 4, and at the other end to the hydrofoil sinker at bracket 27, is laid on the sea bed from a boat in the usual way. Since the float is not operating, chamber 5 will be filled with water and bladder 6 will be compressed into a small volume by the pressure of this water. After a predetermined time, the corrodable link 21 with the shortest life will fail, permitting its associated cam 18 to move under the force of spring 20. The resulting displacement of arm 8 turns valve stem 16, which opens valve 7 to permit air to pass from cylinder 1, through tube 11, to inflate bladder 6. When the pressure in bladder 6 exceeds that of the water outside the chamber, it presses upon flooding valve 12 and closes it. This causes fork 13 to move downwards on to arm 8 and restore it to its starting position, which movement closes valve 7. With water displaced from the chamber, this now rises towards the surface, carrying the gear and hydrofoil sinker with it. As it rises, the external water pressure drops and when this reaches the level where valve 10 is actuated, air is released from bladder 6, and water reenters chamber 5 through flooding valve 12, causing the entire system to sink again.

Because of its hydrofoil construction, however, the sinker does not fall vertically downwards, but "glides", thus pulling the attached gear horizontally. The gear will therefore land on a different part of the sea bed to that from which it was lifted by the float. After a further predetermined time the next corrodable link breaks to inaugurate a second cycle of lift and gliding fall, and so on until all links in the array have broken. For retrieval, the system may have a conventional marker float and line attached to it, or, for compactness, the marker float line may be held on a reel whose unwinding is controlled by a corrodable link assembly in which the link has a longer time to failure than the longestlasting link in the release array.

It will be clear that the mechanism of bladder 6, valve 12, fork 13, arm 8 and valve 7, for isolating the gas source from the bladder, requires no setting for any particular depth. It will always operate as soon as pressure in the bladder exceeds ambient water pressure, whether this is high or low. Ignoring the small pressure required to overcome the force of spring 14, this means that the isolating mechanism can operate down to a depth where the ambient water pressure equals the residual pressure in the gas source after charging the bladder. It can also operate when ambient water pressure is at its lowest, i.e. when the apparatus is at the surface, where pressure is atmospheric for all practical purposes, and at any intermediate depth.

Figure 8:
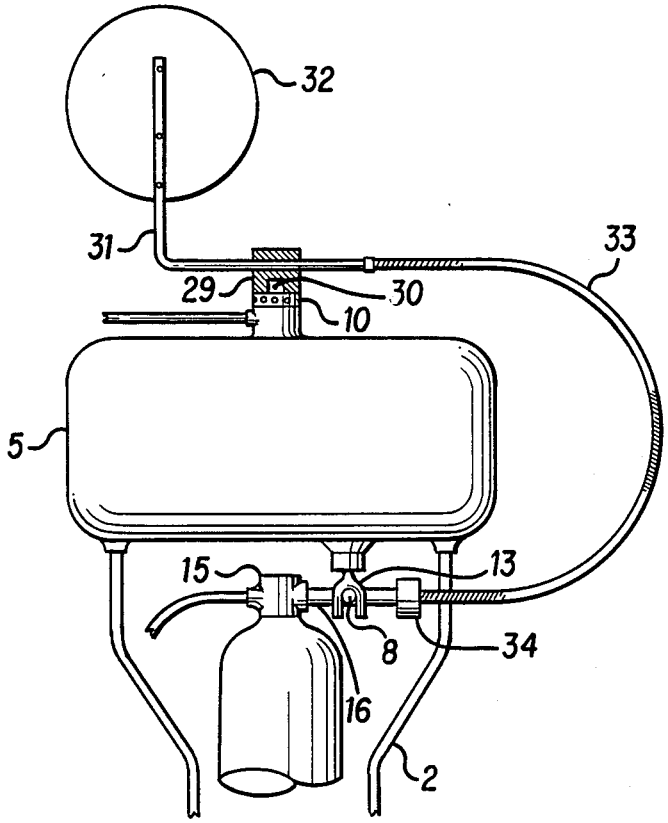
FIG. 8 is an elevational view with sectional detail, of the float system when controlled by a timer which is responsive to tidal movements.

In certain locations it may be possible to use the periodicity of the tides as a timer, instead of corrodable links, and this is illustrated in FIG. 8. In this version, bearing 29 is mounted on top of chamber 5 so that it can pivot in a horizontal plane around axle 30. Bearing 29 carries one arm of crank 31, the free arm having fixed to it, slightly buoyant reaction surface 32. Crank 31 is drivably connected to valve stem 16 of cylinder 1 through flexible shaft 33 and ratchet or free-wheel clutch 34. When this system is dropped on to the sea bed in a tidal current, the force of the current on reaction surface 32 pulls this over in the current direction, and aligns the free arm of crank 31 in the plane of the current flow by pivoting bearing 29 about axle 30. From then onwards, crank 31 will move reciprocally with the reversals in the tidal flow, and act upon valve stem 16. The effect of free-wheel clutch 34 is to use movement in one direction only and to prevent a movement being cancelled by a reverse movement of the crank. Each tide therefore results in a quarter turn of valve stem 16, and this valve can be arranged to open after any required number of quarter turns. All other elements of the system are the same as when corrodable links are used as timers, except that arm 8 can be short, as there are no cams. Return of arm 8 under the action of fork 13, although it turns valve stem 16, is not impeded by flexible shaft 33 because the connection is through ratchet clutch 34.

The air under pressure in cylinder 1 may simply be introduced from a compressor. An alternative method, however, is to obtain gas by chemical or electro-chemical means. A mixture of Sodium Borohydride and sea water, for example, is a plentiful source of hydrogen, and such a mixture could be introduced into the cylinder before laying the gear. Hydrogen is also evolved during galvanic corrosion of Magnesium, according to the equation $Mg. + 2H_2O = Mg.\ (OH)_2 \neq H_2$. A suitable galvanic couple could also be introduced into the cylinder before laying the gear. In both cases, there is ample time between "lifts" for pressure to be built up.

Alternative means of carrying the invention into effect, which do not go beyond the limits of its protection as claimed, include: All valves could be microprocessor-controlled, and actuated by solenoids, or by opening circuits to impress a current on links made from material that is high in the galvanic series in sea water. Valve 10 could be timer controlled like valve 7 instead of depending upon external water pressure. Since the speed of ascent could be established by calculation or experiment, such timed actuation could be related to a predetermined water depth, or the time interval after inflation could be such as to ensure that the gear will have reached the surface, i.e. zero depth. Valve 10 could also be arranged to leak gas at a predetermined rate.

Release of gas from the buoyancy chamber or cylinder could be used instead of the hydrofoil sinker, to achieve lateral movement of the system. Hydrofoils attached directly to the frame 2 could function in the same manner as the hydrofoil sinker, and would cause lateral movement during ascent as well as fall.

A differential pressure valve could be incorporated in the system to bleed off excess pressure in the bladder 6 as the apparatus rises through the water. This would enable container 5 to be more lightly constructed, since it would not have to be pressure-resistant to any significant extent.

I claim:

1. An autonomous multi-cycle marine gear sea-bed traversing system including flotation means, said flotation means comprising: means to connect said flotation means to marine gear for raising and lowering said gear and said flotation means in water; displacement means for displacing water within said flotation means with a gas; a pressurized source of said gas for charging said displacement means to raise said flotation means and said gear; first valve means for cyclically exposing said displacement means to said source of gas; actuating means mechanically connected to said first valve means for closing said first valve means after each charging cycle in response to movement of said displacement means; second valve means for automatically venting said gas from said displacement means when said flotation means and said gear have risen to a depth having a predetermined ambient water pressure; and timing means for opening said first valve means at a plurality of predetermined intervals after said flotation means has been placed in the water, each of said intervals being longer than the time required to complete one said cycle of raising and lowering.

2. A system as in claim 1, further comprising moving means for introducing a horizontal component of motion to said flotation means and said gear during vertical movement of said flotation means and said gear; said moving means being separate from said flotation means and including means to connect said moving means to said gear.

3. An autonomous, multi-cycle seabed traversing system, comprising, in combination, flotation means wherein water can be displaced by gas, a source of gas under pressure for charging said flotation means, independent timer control means for opening said flotation means to said gas source at intervals, means for isolating said source from said flotation means when charging causes flotation, means for venting said flotation means when said system has risen to a predetermined depth and autonomous means for moving said system horizontally.

* * * * *